United States Patent [19]

Bachar

[11] Patent Number: 4,962,563

[45] Date of Patent: Oct. 16, 1990

[54] FLOOR RAG CLAMP

[76] Inventor: Raphael Bachar, 15 Messilat Yesharim St., Tel Aviv, Israel

[21] Appl. No.: 129,724

[22] Filed: Dec. 7, 1987

[30] Foreign Application Priority Data

Dec. 10, 1986 [IL] Israel ..... 80938

[51] Int. Cl.[5] ..... A47L 13/24

[52] U.S. Cl. ..... 15/147 R; 15/228

[58] Field of Search ..... 15/146, 147 C, 147 R, 15/151, 152, 228, 229.2, 229.1, 229.5, 231, 232, 233

[56] References Cited

U.S. PATENT DOCUMENTS

| | | | |
|---|---|---|---|
| 2,299,810 | 10/1942 | Fatland | 15/146 |
| 2,419,748 | 4/1947 | Weber et al. | 15/231 |
| 2,440,014 | 4/1948 | Ludwick | 15/147 R |
| 2,712,144 | 7/1955 | Dunn | 15/151 |
| 2,845,643 | 8/1958 | Provencal et al. | 15/105 |

FOREIGN PATENT DOCUMENTS

| | | |
|---|---|---|
| 199086 | 6/1908 | Fed. Rep. of Germany . |
| 3505973 | 8/1986 | Fed. Rep. of Germany . |
| 214576 | 5/1941 | Switzerland . |

*Primary Examiner*—Harvey C. Hornsby
*Assistant Examiner*—Scott J. Haugland
*Attorney, Agent, or Firm*—Ostrolenk, Faber, Gerb & Soffen

[57] ABSTRACT

A clamp for long-handle floor-washing wipers or scrub-brushes, which comprise an elongated head for a wiper blade or brush carried at the end of a broomstick, the clamp being adapted to releasably hold a rag and prevent its slipping-off the head during use. The clamp is comprised of two springy arms, spaced from each other and extending in alignment in a common plane, and a frame holding the arms by the respective extreme, outer ends thereof. The distance between the inner, free ends of the arms is slightly less than the diameter of the stick. When the clamp is mounted, with the stick squeezed between the free ends of the arms, the arms become flexed, thereby displacing the frame into either an engaging or a disengaging position with respect to the wiper head.

1 Claim, 5 Drawing Sheets

FLOOR RAG CLAMP

BACKGROUND OF THE INVENTION

The present invention relates to implements used to ease housework chores especially as regards washing floors.

More specifically, the invention concerns the prevalent floor-washing technique, using a wash-rag associated with a wiper, attached to the end of a broomstick. This combination of implements is widespread due to its low cost and simplicity, whereby the same tools are used for washing, rinsing, wiping and drying the floor. At different stages of the job the floor-rag is removed, rinsed, wrung and hung back over the wiper-head attached to the stick.

It has long been felt that the method of draping the rag over the wiper is clumsy and requires multiple re-adjustments, and even frequent removal and re-draping of the rag in the course of mopping up. The constant slipping-off of the rag, and its uneven spread is the source of much discomfort and frustration. Homemakers have long demanded a simple, inexpensive contraption to hold the rag in place, and at the same time enable quick and effortless release of the rag.

It is thus the main object of the present invention to provide a clamp, for long-handle scrub-brushes, rag-mops, and the like floor-washing wipers, having an elongated head and broomstick, for holding a rag in place and prevent its slipping off the wiper-head during use.

It is a further object of the invention that such clamp be easily mounted on and adaptable to conventional floor-wipers and broomsticks.

It is a still further object of the invention that such clamp be alternately engaged and disengaged from the rag in a convenient manner and with negligible effort. A still further object of the invention is that such clamp be made of inexpensive, molded plastic material and mass-produced, and thus be within reach of the average homemaker.

SUMMARY OF THE INVENTION

According to the invention there is provided a clamp for floor-washing wipers, long-handle scrub-brushes, and the like, which comprise an elongated head for a wiper blade, or brush carried at the end of a broomstick, the clamp being adapted to releasably hold a rag and prevent its slipping-off the head during use. The clamp is comprised of two springy arms, spaced from each other and extending in alignment in a common plane, and a frame holding the arms by the respective extreme, outer ends thereof, the distance between the inner, free ends of the arms being slightly less than the diameter of the stick. When the clamp is mounted with the stick squeezed between the free ends of the arms, the arms become flexed, thereby displacing the frame into a position distanced from and parallel to the plane at one or the other side thereof.

BRIEF DESCRIPTION OF THE DRAWINGS

These and other constructional features and advantages of the present invention will become apparent in the light of the following description, given by way of example only, with reference to the accompanying drawings, wherein.

DETAILED DESCRIPTION OF THE PREFERRED EMBODIMENTS

Figure 1:
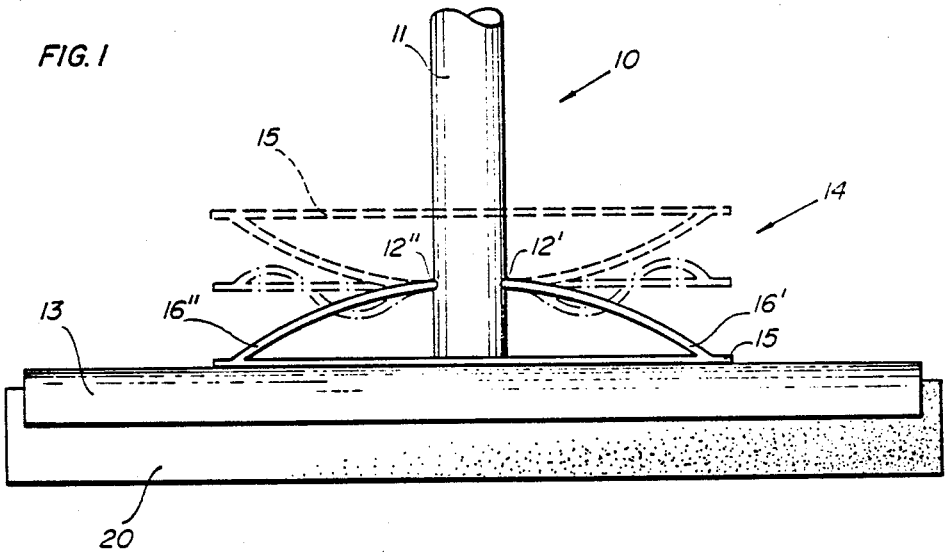
FIG. 1 shows a general front-view of a floor-wiper with a clamp according to a first embodiment of the invention installed thereon.
Figure 2:
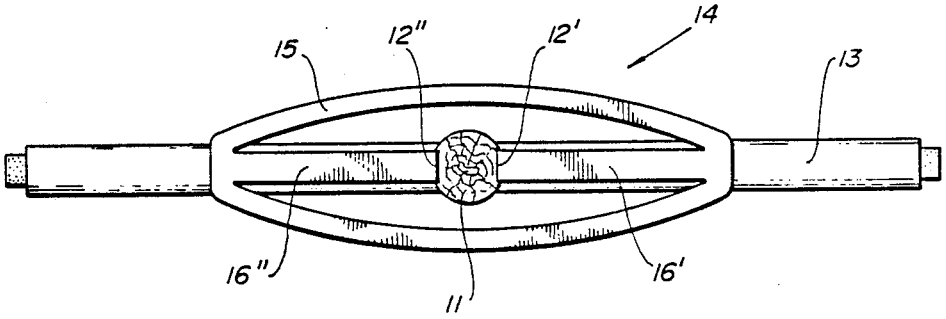
FIG. 2 is a top-view of FIG. 1.

In FIGS. 1 and 2 there is shown a long-handle floor-wiper, generally denoted 10, comprising a broom handle 11 with knife-edge notches 12' and 12'' cut into its circumference, an elongated wiper-head 13, and a floor-rag clamp generally denoted 14, provided according to one embodiment of the present invention.

Clamp 14 comprises an elliptical frame 15, and two flat symmetrical springy arms 16' and 16'', extending from the frame 15, along the major axis thereof, diametrically opposite one to the other in the same plane. While the frame 15 may be of any rigid material, the arms 16 must be made of flexible material such as plastic or springy sheet metal to enable performance of the function of the clamp as explained further below. The distance between the inner, free ends of the arms 16' and 16'' must be slightly less than the distance between the insides of the notches 12', 12''.

The clamp 14 is mounted with the stick 11 squeezed between the free ends of the arms 16, and inserted into the notches 12, which act as a fulcrum. Such mounting causes the arms 16 to become flexed and the frame 15 pushed into one of two positions: The engaged position, in which the frame 15 presses against wiper-head 13; or the raised, disengaged position, shown in broken lines, wherein the frame 15 is out of contact with the wiper-head. As indicated in FIG. 1 in dash-dotted lines, the clamp 14 passes through an intermediate, transient position at the dead-center point between the fully-engaged and the fully-disengaged positions.

Figure 3:
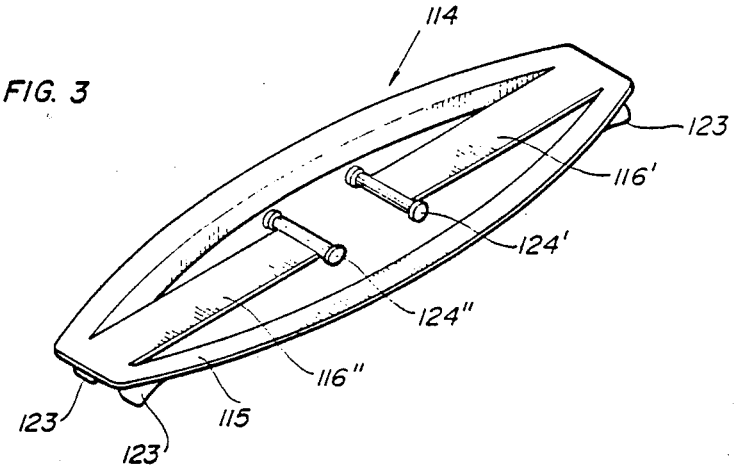
FIG. 3 shows an improved embodiment of the clamp, with means for mounting same on a wiper bracket, and added means for securing the grasping of a rag.
Figure 4:
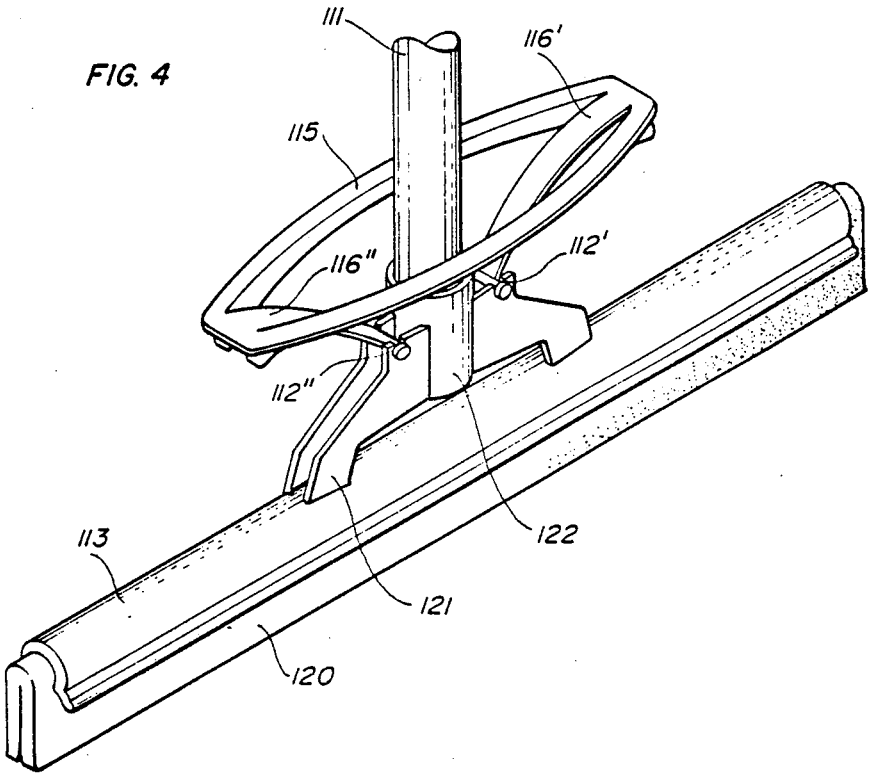
FIG. 4 shows the clamp of FIG. 3 mounted on a wiper head with bracket, in a disengaged position.
Figure 5:
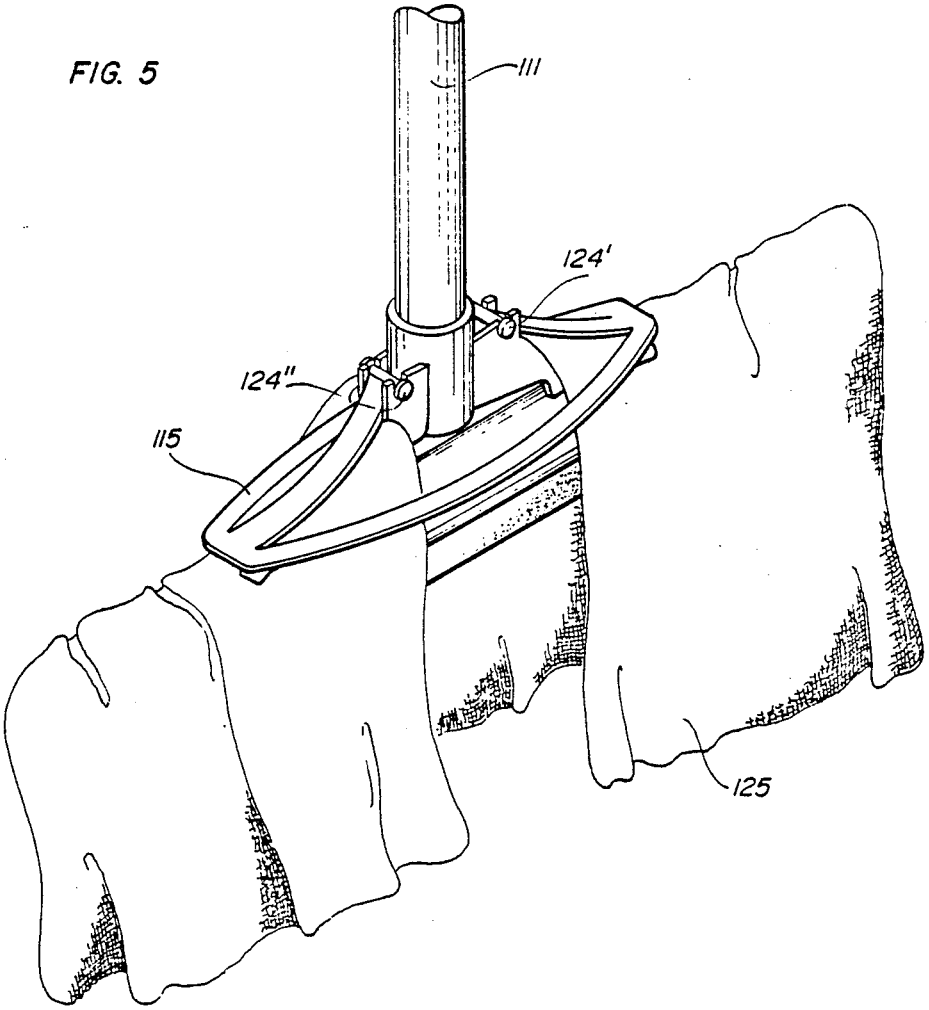
FIG. 5 shows the clamp of FIG. 3 in an engaged position, grasping the rag and holding it in place on the wiper-head.

The clamp of FIGS. 3–5 is an improved embodiment of the one illustrated in FIGS. 1 and 2, in that it is designed to be applied to a most popular type of floor wiper. Similar reference numerals are used to denote corresponding parts.

As shown in FIGS. 4 and 5, the conventional floor wiper comprises a wiper-head 113 with a rubber blade 120. It is mounted on the broomstick 111 with a bracket 121 having a cup-shaped socket 122 (which may or may not be nailed to the stick).

The head 113 and bracket 121 are made integrally by plastic molding.

A pair of oppositely located semi-circular recesses 112' and 112'' are applied by and during the molding of the bracket, serving as fulcra for the improved clamp, as best seen in FIG. 3.

Thus, the clamp 114 comprises the elliptical frame 115 and arms 116; however, there are provided two or more pairs of projections, or cleats, denoted 123, which project downwards from the frame. Each of the free ends of the springy arms 116' and 116" terminates in a cylinder-shaped member 124', 124", adapted to fit into fulcrum recesses 112 located on opposite sides of cup-shaped socket 122 in bracket 121.

Again, the clamp 114 mounted as described above can reach two static positions only, namely the engaged position shown in FIG. 5, where it securely grasps rag 125, and the disengaged position shown in FIG. 4. When in any intermediate position the clamp is structurally forced into either the fully-engaged or the fully-disengaged position, determined by whether the clamp 114 has been lowered below the dead-center point o raised above it.

The operation of the clamp as so far described will now be clearly understood. When commencing work with the long-handled floor wiper, the clamp will be in the disengaged position shown in FIG. 4 (or broken line in FIG. 1). The floor-rag can then be draped over the wiper head in the usual manner. Then, the operator will lower the clamp 114 with a gentle push of the fingers, until the clamp jumps over the dead-center point, and the frame 115, aided by the cleats 123, presses the rag 124 against the wiper-head 113 and secures it in place. The rag mop thus assembled can then be used in the ordinary manner to scrub the floor. When it becomes necessary to rinse, wring, or soak the rag, the operator simply raises the frame 115 until it jumps over the dead-center point into the disengaged position, and then removes the rag. This procedure can be repeated over and over again with a flick of the hand.

Figure 6:
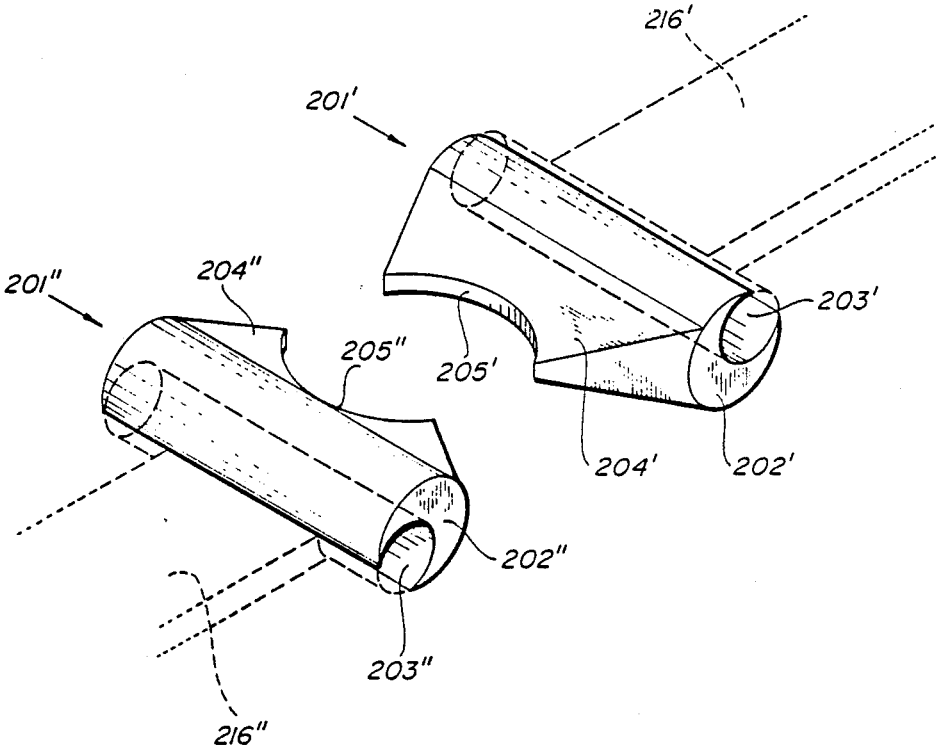
FIG. 6 shows a pair of adaptor inserts for installing the improved clamp shown in FIG. 3 directly on the wiper broomstick, as in the embodiment of FIGS. 1–2.

Referring to FIG. 6, there are shown a pair of adaptor inserts denoted 201' and 201", which enable mounting the improved clamp 114 (shown in FIG. 3) directly on the broomstick (FIGS. 1–2 configuration). The adaptor inserts 201 each consist of an integrally-molded slotted sleeve member 202 of identical length to that of the cylindrical free ends 124 of the springy arms 116. On one side of each insert 201 is a semi-cylindrical concave cavity 203 designed to snugly fit over free ends 124 of the clamp 114. At its other side is a projection 204 with a cut-out semi-circular indenture 205, knurled or lined with pointed projections.

The insert sleeves 202 are slid along the length of the cylindrical free ends 124 (or snapped-over) until snugly attached. When thus appended, they lengthen the springy arms 116 such that the distance between the indentures 205' and 205" is slightly less than the diameter of the broomstick, 111 (or 11) proper.

The clamp 114 is mounted with the help of adaptor inserts 201, with the stick 111 squeezed between the free ends 116, thus prolonged, with the indentures 205 inserted into fulcrum notches 12, and the knurled interior surface or pointed projections becoming partially embedded in the broomstick or, at least, forcibly pressed thereagainst.

Figure 7:
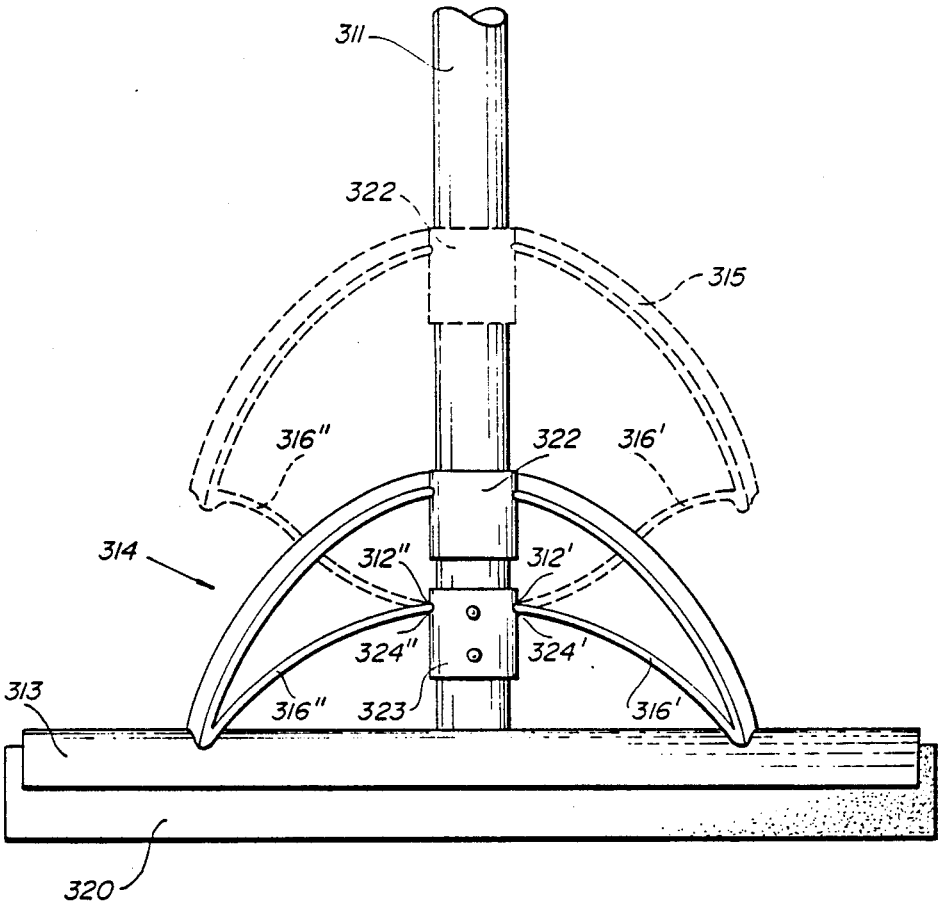
FIG. 7 is a modified version of the clamp according to a still further embodiment of the present invention.

According to the embodiment of the invention exemplified in FIG. 7, clamp 314 comprises an arcuate or triangular frame 315. The frame 315 is rigid, preferably strengthened by having a profiled cross-section, such as T-shaped. The frame 315 lies in the plane of the broomstick 311 which freely passes through a collar or sleeve 322, formed integrally with the frame—if produced by plastic molding.

A pair of springy arms 316' and 316" are provided following the same design as in preceding embodiments. However, the free ends of the arms may be fulcrummed by an additional, ring member 323, nailed or otherwise fixed to the stick 311 at an appropriate distance above the head 313. The ring 323 comprises a pair of knife-edge notches 312', 312" pivotally supporting the free ends 324' and 324" of the arms 316' and 316", respectively.

In operation of the clamp 314, i.e. flexing the frame between the engaged position and the disengaged position shown in broken lines in FIG. 7, the collar 322 will be manipulated in a sliding movement along the stick 311, enhancing the convenience as well as the stability of the implement as whole.

It is thus established that the dual position floor-rag clamp provided according to the present invention offers an inexpensive, easy-to-install and easy-to-use means to hold and secure floor-rags into place on floor wipers and thus greatly facilitate what has hitherto been a tedious and exasperating chore.

Those skilled in the art will be able to make numerous obvious modifications, diversifications, and variations in the clamp hereintofore described, without departing from the scope of the invention as defined in and by the appended claims.

What is claimed is:

1. An implement for releasably holding a rag in place for washing floors, said implement comprising:

an elongated head, said elongated head being attachable to a stick;

a frame, said frame having an opening for passing over said stick and including opposite ends; and a pair of elongated flat springs located within said opening, one end of each flat spring being attached to each opposite end of said frame, the free end of each said spring being pivotally attached to said head for movement with respect to said head; said pair of elongated flat springs being flexed to alternately:

(1) bias said opposite ends of said frame toward said elongated head to hold the rag in place between said opposite ends and said elongated head; and (2) bias said opposite ends of said frame away from said elongated head to release the rag from said implement.

* * * * *